US011141033B2

(12) United States Patent
Une et al.

(10) Patent No.: US 11,141,033 B2
(45) Date of Patent: Oct. 12, 2021

(54) ELECTRIC VACUUM CLEANER

(71) Applicant: TOSHIBA LIFESTYLE PRODUCTS & SERVICES CORPORATION, Kawasaki (JP)

(72) Inventors: Masamichi Une, Kasugai (JP); Yousuke Yajima, Owariasahi (JP)

(73) Assignee: TOSHIBA LIFESTYLE PRODUCTS & SERVICES CORPORATION, Kawasaki (JP)

( * ) Notice: Subject to any disclaimer, the term of this patent is extended or adjusted under 35 U.S.C. 154(b) by 359 days.

(21) Appl. No.: 16/323,080

(22) PCT Filed: May 29, 2017

(86) PCT No.: PCT/JP2017/019929
§ 371 (c)(1),
(2) Date: Feb. 4, 2019

(87) PCT Pub. No.: WO2018/025478
PCT Pub. Date: Feb. 8, 2018

(65) Prior Publication Data

US 2019/0159642 A1 May 30, 2019

(30) Foreign Application Priority Data

Aug. 5, 2016 (JP) ..... JP2016-154464

(51) Int. Cl.
*A47L 9/28* (2006.01)

(52) U.S. Cl.
CPC ..... *A47L 9/2884* (2013.01); *A47L 9/28* (2013.01); *A47L 9/2842* (2013.01)

(58) Field of Classification Search
CPC ..... A47L 9/28; A47L 9/2842; A47L 9/2878; A47L 9/2884
See application file for complete search history.

(56) References Cited

U.S. PATENT DOCUMENTS

2016/0095488 A1* 4/2016 Lee ..... A47L 9/2842 15/319
2018/0103816 A1* 4/2018 Moon ..... A47L 9/2868

FOREIGN PATENT DOCUMENTS

CN 1575740 A 2/2005
CN 104365010 A 2/2015
(Continued)

OTHER PUBLICATIONS

JP-2004057367-A—English Machine Translation (Year: 2004).*
International Search Report dated Jul. 11, 2017 in PCT/JP2017/019929 filed May 29, 2017.

*Primary Examiner* — Marc Carlson
(74) *Attorney, Agent, or Firm* — Oblon, McClelland, Maier & Neustadt, L.L.P.

(57) ABSTRACT

An electric vacuum cleaner including: a secondary battery; an electric blower that generates negative pressure by consuming electricity stored in the rechargeable battery; and a control unit that controls driving of the electric blower, and changes discharge current of the rechargeable battery based on the difference between terminal voltage of the rechargeable battery while the electric blower is stopped and terminal voltage of the rechargeable battery after a predetermined time has elapsed since the electric blower has been started up. The electric vacuum cleaner can continue driving of an electric blower and increase operation time even in the state that the internal resistance of a rechargeable battery is increased.

12 Claims, 4 Drawing Sheets

(56) References Cited

FOREIGN PATENT DOCUMENTS

| | | | | |
|---|---|---|---|---|
| EP | 1 367 687 | A1 | | 12/2003 |
| EP | 3 001 940 | A1 | | 4/2016 |
| JP | 11-56725 | A | | 3/1999 |
| JP | 2004-57367 | A | | 2/2004 |
| JP | 2004057367 | A | * | 2/2004 |
| JP | 2004089435 | A | * | 3/2004 |
| JP | 2004129913 | A | * | 4/2004 |
| JP | 2005-131110 | A | | 5/2005 |
| JP | 2007-178333 | A | | 7/2007 |
| JP | 2012-221648 | A | | 11/2012 |
| JP | 2014-21 2826 | A | | 11/2014 |
| JP | 2016152887 | A | * | 8/2016 |
| JP | 2017060575 | A | * | 3/2017 |
| WO | WO 02/073770 | A1 | | 9/2002 |
| WO | WO 2014/000794 | A1 | | 1/2014 |

* cited by examiner

ELECTRIC VACUUM CLEANER

CROSS-REFERENCE TO RELATED APPLICATION

This application claims the benefit of priority of No. PCT/JP2017/019929, filed on May 29, 2017, and the PCT application is based upon and claims the benefit of priority from Japanese Patent Application No. 2016-154464 filed on Aug. 5, 2016, the entire contents of each of which are incorporated herein by reference.

FIELD

Embodiments according to the present invention relate to an electric vacuum cleaner.

BACKGROUND

There is known an electric vacuum cleaner that consumes electricity stored in a rechargeable battery and drives an electric blower. Life of a rechargeable battery such as a lithium ion battery becomes shorter when the rechargeable battery is brought into an overdischarged state. When the terminal voltage drops to the discharge cut-off voltage, it is necessary to stop the electric vacuum cleaner and urge charging of the rechargeable battery.

There is also known an electric vacuum cleaner that changes the amount of electricity (i.e., energization amount) supplied to the electric blower depending on the amount of dust sucked in.

However, when the energization amount of a large load such as an electric blower is changed, the battery voltage drastically drops and thereby the terminal voltage of the rechargeable battery becomes lower than the discharge cut-off voltage, which causes the electric vacuum cleaner to suddenly stop in some cases.

For this reason, there is known an electric vacuum cleaner that suppresses the voltage drop by decreasing the energization amount of the electric blower so as to prevent the electric blower from suddenly stopping and efficiently use up the battery capacity to the end when the terminal voltage of the rechargeable battery is lower than a reference voltage.

When the terminal voltage of the rechargeable battery falls below the discharge cut-off voltage, the conventional electric vacuum cleaner prevents overdischarge of the rechargeable battery by stopping the electric blower and avoids exhaustion of the life of the rechargeable battery.

PRIOR ART DOCUMENT

Patent Document

Patent Document 1: Japanese Unexamined Patent Application Publication No. 2014-212826

SUMMARY

Problems to be Solved by Invention

The internal resistance of the rechargeable battery is influenced by the temperature and/or the degree of deterioration of the rechargeable battery. The internal resistance of the rechargeable battery increases as the temperature of the rechargeable battery decreases or the deterioration of the rechargeable battery progresses.

When the electric blower is started while maintaining the discharge current of the rechargeable battery (i.e., amount of electricity supplied to the electric blower) under the state where the internal resistance of the rechargeable battery is higher than the normal state, the voltage drop of the rechargeable battery increases more than that in the normal state. As the voltage drop increases, there is a possibility that the terminal voltage of the rechargeable battery falls below the discharge cut-off voltage.

Decrease in the terminal voltage due to increase in the internal resistance of the rechargeable battery occurs regardless of the charging rate of the rechargeable battery. Consequently, even in the case where the charging rate of the rechargeable battery is sufficient in the conventional electric vacuum cleaner, when the temperature of the rechargeable battery decreases and/or the rechargeable battery deteriorates, the internal resistance of the rechargeable battery increases, and thereby the terminal voltage of the rechargeable battery drops below the discharge cut-off voltage, the electric blower of the conventional electric vacuum cleaner is stopped immediately after starting, which impairs the user's convenience.

Accordingly, it is an object of the present invention to provide a highly convenient electric vacuum cleaner that can continue driving of the electric blower and increase operation time even in the state where the internal resistance of the rechargeable battery is increased.

Means for Solving Problem

To achieve the above object, an aspect of the present invention provides an electric vacuum cleaner including: a rechargeable battery; an electric blower that generates negative pressure by consuming electricity stored in the rechargeable battery; and a controller configured to control driving of the electric blower, and change discharge current of the rechargeable battery based on difference between a terminal voltage of the rechargeable battery while the electric blower is stopped and a terminal voltage of the rechargeable battery after a predetermined time has elapsed since the electric blower has been started up.

It may be desired that the controller is configured to change the discharge current of the rechargeable battery when the difference is larger than a predetermined threshold value.

It may be desired that the controller is configured to change the discharge current of the rechargeable battery based on the difference each time the controller starts the electric blower.

It may be desired that the controller is configured to change the discharge current of the rechargeable battery based on the difference calculated before stop of the electric blower, when elapsed time from the stop of the electric blower to restart of the electric blower is within a predetermined time interval.

It may be desired that the controller is configured to continue the driving of the electric blower until a determination time longer than the predetermined time elapses, even when a terminal voltage of the rechargeable battery is equal to or smaller than a discharge cut-off voltage.

DETAILED DESCRIPTION

Hereinbelow, an embodiment of an electric vacuum cleaner according to the present invention will be described by referring to FIG. 1 to FIG. 4.

Figure 1:
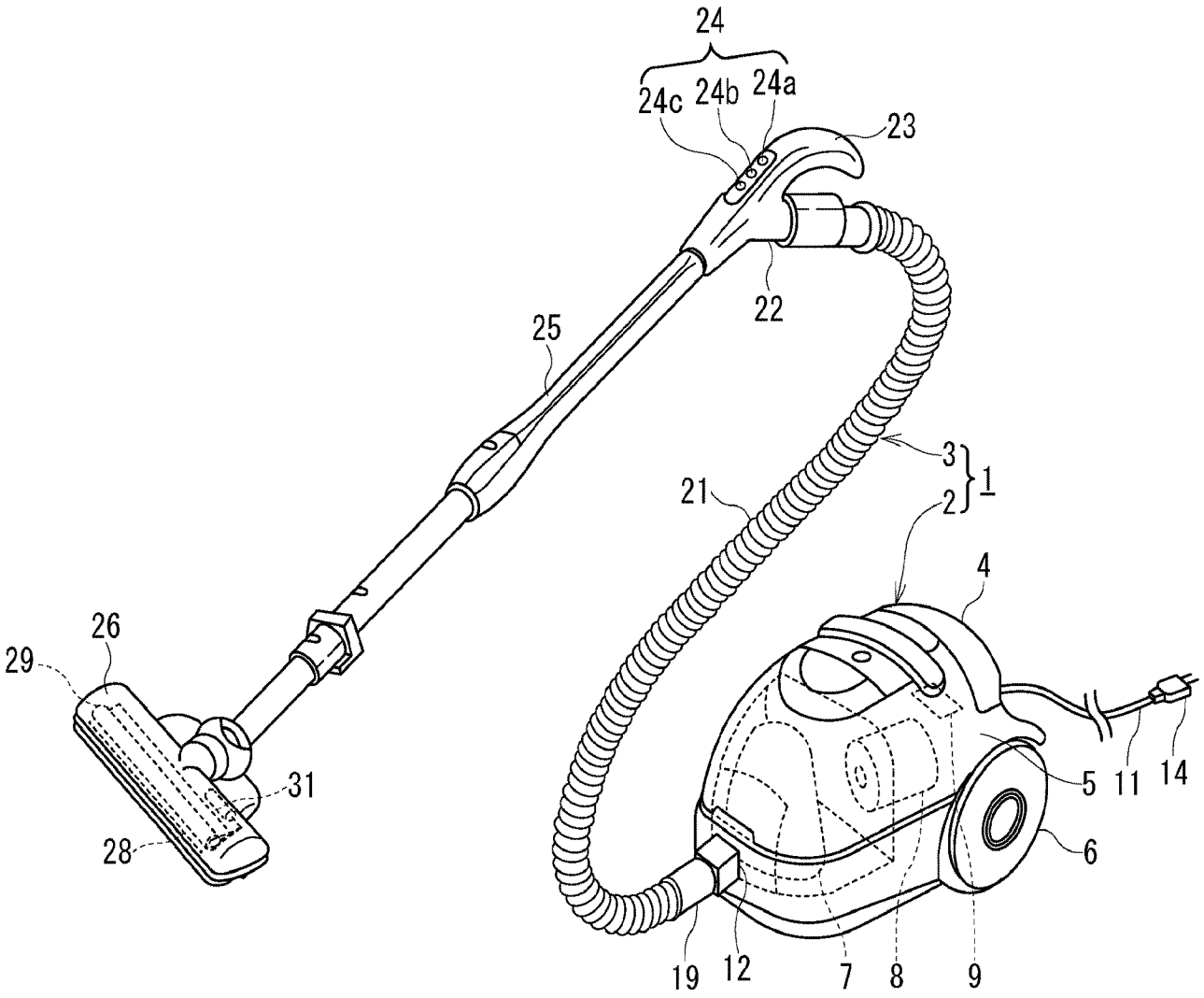
FIG. 1 is a perspective view of an electric vacuum cleaner according to an embodiment of the present invention.

FIG. 1 is a perspective view of the electric vacuum cleaner according to the embodiment of the present invention.

As shown in FIG. 1, the electric vacuum cleaner 1 according to the present embodiment is a so-called canister type. The electric vacuum cleaner 1 includes a cleaner body 2, a hose 3 detachable from the cleaner body 2, and a rechargeable battery 4 as a power source detachable from the cleaner body 2. The hose 3 is fluidly connected to the cleaner body 2.

The rechargeable battery 4 is, e.g., a lithium ion battery. The rechargeable battery 4 includes a non-illustrated protection circuit for avoiding overcharge and/or overdischarge.

The cleaner body 2 includes a body housing 5, a pair of wheels 6 provided on the respective right and left sides of the body housing 5, a detachable dust separation and collection device 7 arranged in the front half of the body housing 5, an electric blower 8 accommodated in the rear half of the body housing 5, a controller 9 mainly for controlling the electric blower 8, and a power cord 11 used for charging the rechargeable battery 4.

The cleaner body 2 drives the electric blower 8 by using the electric power stored in the rechargeable battery 4. The cleaner body 2 causes the negative pressure generated by driving of the electric blower 8 to act on the hose 3. The electric vacuum cleaner 1 sucks dust-containing air from the surface to be cleaned through the hose 3, separates dust from the dust-containing air, and collects and accumulates the separated dust so as to exhaust clean air from which the dust has been removed.

A body connection port 12 is provided in the front portion of the body housing 5. The body connection port 12 is a fluid inlet of the cleaner body 2. The body connection port 12 fluidly connects the hose 3 to the dust separation and collection device 7. A non-illustrated coupling mechanism to which the rechargeable battery 4 is mechanically connected is provided on the back of the body housing 5.

Each of the wheels 6 is a large-diameter running wheel that supports the cleaner body 2 on the surface to be cleaned.

The dust separation and collection device 7 separates dust from dust-containing air flowing into the cleaner body 2, collects and accumulates dust, while sending clean air from which dust has been removed to the electric blower 8. The dust separation and collection device 7 may be a centrifugal separation type or a filtration separation type.

The electric blower 8 consumes electric power stored in the rechargeable battery 4 so as to generate negative pressure. The electric blower 8 sucks air from the dust separation and collection device 7 so as to generate negative pressure (i.e., suction vacuum pressure).

The controller 9 includes a non-illustrated microprocessor and a non-illustrated storage device that stores parameters and various operation programs to be executed by the microprocessor. The storage device stores various settings (arguments) related to plural preset operation modes. The plural operation modes are related to the output of the electric blower 8. Different input values (input values of the electric blower 8 and current values flowing to the electric blower 8) are set for each operation mode. Each operation mode corresponds to a user's operation received by the hose 3. The controller 9 alternatively selects an arbitrary operation mode corresponding to the user's operation received by the hose 3 from the plural preset operation modes, and reads out the selected operation mode from the storage device so as to control the electric blower 8 on the basis of the settings of the operation mode being read out.

The power cord 11 is attachable to and detachable from the cleaner body 2, and supplies electric power from a non-illustrated plug insertion connector of AC power sockets (so-called outlet) to the rechargeable battery 4. An insertion plug 14 is provided at the free end of the power cord 11. The rechargeable battery 4 is charged via the power cord 11.

The hose 3 sucks dust-containing air from the surface to be cleaned by the negative pressure that acts from the cleaner body 2. The hose 3 leads the dust-containing air having been sucked to the cleaner body 2. The hose 3 includes a connecting tube 19 detachably connected as a joint to the cleaner body 2, a dust collecting hose 21 fluidly connected to the connecting tube 19, a hand operation tube 22 fluidly connected to the dust collecting hose 21, a grip 23 protruding from the hand operation tube 22, an operation unit 24 provided on the grip 23, an extension tube 25 detachably connected to the hand operation tube 22, and a cleaning head 26 detachably connected to the extension tube 25.

The connecting tube 19 is the joint that is detachable with respect to the body connection port 12, and is fluidly connected to the dust separation and collection device 7 through the body connection port 12.

The dust collecting hose 21 is a long, flexible, and substantially cylindrical hose. One end (i.e., the rear end in this case) of the dust collecting hose 21 is fluidly connected to the connecting tube 19. The dust collecting hose 21 is fluidly connected to the dust separation and collection device 7 through the connecting tube 19.

The hand operation tube 22 relays the dust collecting hose 21 and the extension tube 25. One end (i.e., the rear end in this case) of the hand operation tube 22 is fluidly connected to the other end (i.e., the front end in this case) of the dust collecting hose 21. The hand operation tube 22 is fluidly connected to the dust separation and collection device 7 through the dust collecting hose 21 and the connecting tube 19.

The grip 23 is a portion that a user grips with the hand in order to operate the electric vacuum cleaner 1. The grip 23 protrudes from the hand operation tube 22 in an appropriate shape that can be easily grasped by a user's hand.

The operation unit 24 includes switches corresponding to the respective operation modes. Specifically, the operation unit 24 includes a stop switch **24*a* corresponding to a stopping operation of the electric blower 8, a start switch 24*b* corresponding to a starting operation of the electric blower 8, and a brush switch 24*c* corresponding to power supply to the cleaning head 26. The stop switch 24*a* and the start switch 24*b* are electrically connected to the controller 9. A user of the electric vacuum cleaner 1 can operate the operation unit 24 to alternatively select one of the operation modes of the electric blower 8. The start switch 24*b* also functions as a selecting switch of the operation modes during operation of the electric blower 8. In this case, each time the controller 9 receives an operation signal from the start switch 24***b*, the controller 9 switches the operation mode in order of strong→medium→weak→strong→medium→weak→ . . . . Instead of the start switch 24*b*. The operation unit 24 may be individually equipped with a strong-mode operation switch, a medium-mode operation switch, and a weak-mode operation switch (not shown).

The extension tube 25 has a telescopic structure in which plural tubular bodies are superimposed, and is an elongated substantially cylindrical tube that can be expanded and contracted. A joint structure is provided at one end (i.e., the rear end in this case) of the extension tube 25, and this joint structure is detachable with respect to the other end (i.e., the front end in this case) of the hand operation tube 22. The extension tube 25 is fluidly connected to the dust separation and collection device 7 through the hand operation tube 22, the dust collecting hose 21, and the connecting tube 19.

The cleaning head 26 can run or slide on the surface to be cleaned such as a wooden floor and a carpet. The cleaning head 26 includes a suction port 28 on its bottom surface opposed to the surface to be cleaned in a running state or a sliding state. In addition, the cleaning head 26 includes a rotatable brush 29 arranged at the suction port 28 and an electric motor 31 for driving the rotatable brush 29. A joint structure is provided on one end portion (i.e., the rear end portion in this case) of the cleaning head 26, and this joint structure is detachable with respect to the other end portion (i.e., the front end portion in this case) of the extension tube 25. The cleaning head 26 is fluidly connected to the dust separation and collection device 7 through the extension tube 25, the hand operation tube 22, the dust collecting hose 21, and the connecting tube 19. That is, the cleaning head 26, the extension tube 25, the hand operation tube 22, the dust collecting hose 21, the connecting tube 19, and the dust separation and collection device 7 are a suction-air passage that is spatially connected from the electric blower 8 to the suction port 28. Each time the brush switch 24*c* is operated, the electric motor 31 alternately repeats the operation start and the operation stop.

The electric vacuum cleaner 1 starts up the electric blower 8 when the start switch 24*b* is operated. For instance, when the start switch 24*b* is operated under the state where the electric blower 8 is stopped, the electric vacuum cleaner 1 firstly drives the electric blower 8 in the strong operation mode. When the start switch 24*b* is operated again in the strong operation mode, the electric vacuum cleaner 1 drives the electric blower 8 in the medium operation mode. When the start switch 24*b* is operated three times (i.e., it is operated in the medium operation mode), the electric vacuum cleaner 1 drives the electric blower 8 in the weak operation mode. In this manner, every time the start switch 24*b* is operated, the above-described mode switching is repeated. The strong operation mode, the medium operation mode, and the weak operation mode are plural predetermined operation modes, and the input value to the electric blower 8 is smaller in order of the strong operation mode, the medium operation mode, and the weak operation mode. The electric blower 8 in operation discharges the air from the dust separation and collection device 7 so as to bring the inside of the dust separation and collection device 7 into a negative pressure state.

The negative pressure inside the dust separation and collection device 7 sequentially passes through the body connection port 12, the connecting tube 19, the dust collecting hose 21, the hand operation tube 22, the extension tube 25, and the cleaning head 26 so as to act on the suction port 28. The electric vacuum cleaner 1 sucks dust on the surface to be cleaned together with air by the negative pressure acting on the suction port 28 so as to clean this surface. The dust separation and collection device 7 separates dust from the dust-containing air sucked into the electric vacuum cleaner 1 and accumulates the separated dust, while sending air having been separated from the dust-containing air to the electric blower 8. The electric blower 8 discharges the air sucked from the dust separation and collection device 7 to the outside of the cleaner body 2.

Figure 2:
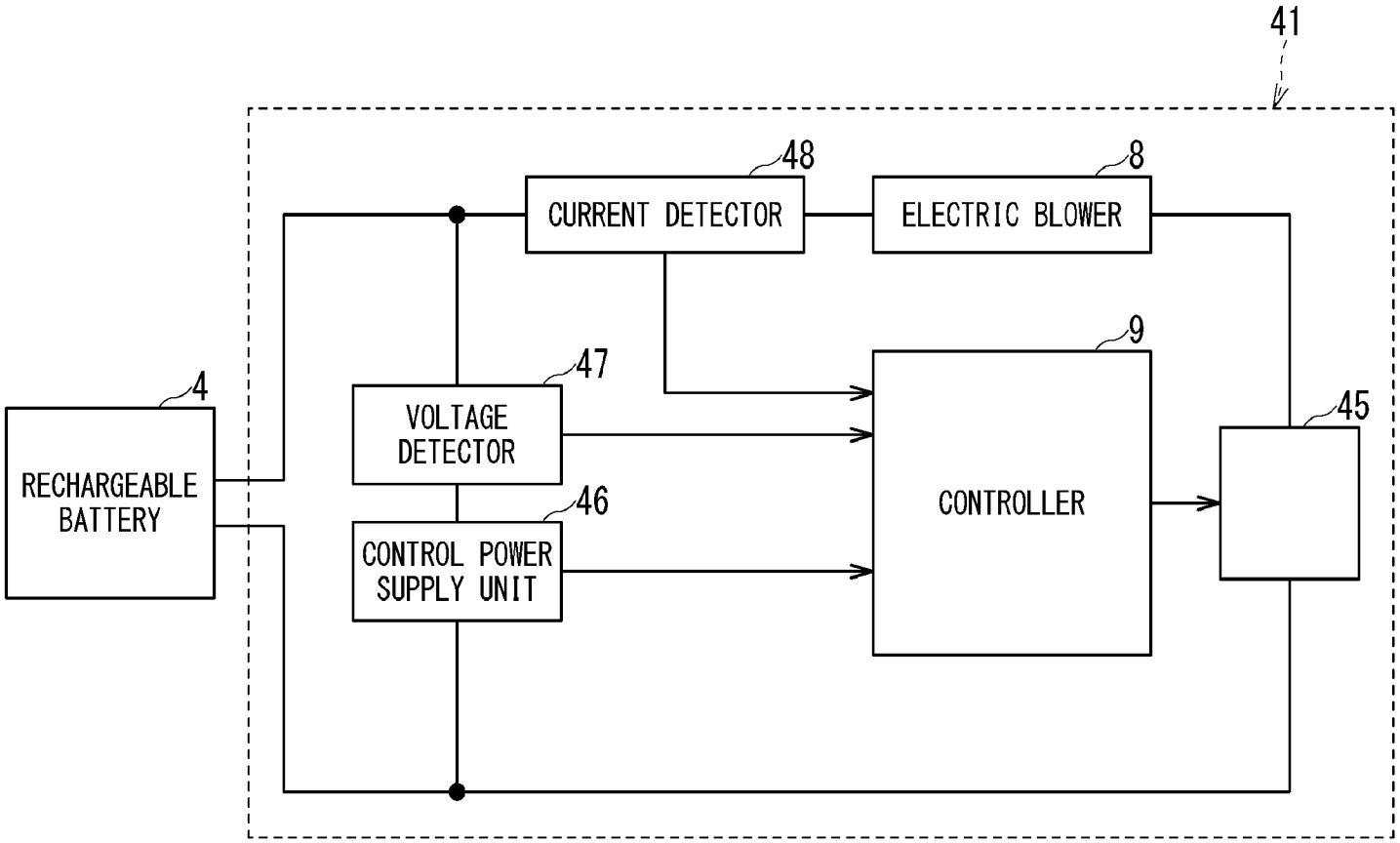
FIG. 2 is a block diagram of the electric vacuum cleaner according to the embodiment of the present invention.

FIG. 2 is a block diagram of the electric vacuum cleaner according to the embodiment of the present invention.

As shown in FIG. 2, the electric vacuum cleaner 1 according to the present embodiment includes a control circuit 41 electrically connected to the rechargeable battery 4.

The control circuit 41 controls the driving of the electric blower 8 by adjusting the current flowing from the rechargeable battery 4 to the electric blower 8. The control circuit 41 includes the controller 9 and the electric blower 8 that generates negative pressure by consuming electricity stored in the rechargeable battery 4. The controller 9 controls the driving of the electric blower 8 and changes the discharge current of the rechargeable battery 4 on the basis of the difference $\Delta V$ between the terminal voltage V1 of the rechargeable battery 4 while the electric blower 8 is stopped and the terminal voltage V2 of the rechargeable battery 4 after a predetermined time has elapsed since the electric blower 8 has been started up. The control circuit 41 further includes a switching element 45 configured to open and close an electric path 43 connecting the rechargeable battery 4 to the electric blower 8, a control power supply unit 46 configured to convert the terminal voltage of the rechargeable battery 4 into a control voltage and supply electric power to the controller 9, a voltage detector 47 configured to detect the terminal voltage of the rechargeable battery 4 and output the detected terminal voltage to the controller 9, and a current detector 48 configured to detect the current flowing through the electric blower 8 and output the detected current to the controller 9.

The terminal voltage of the rechargeable battery 4 is also called a battery voltage.

The electric blower 8 is connected in series to the rechargeable battery 4.

The switching element 45 is, e.g., a field effect transistor (FET). The switching element 45 has a gate connected to the controller 9. The switching element 45 changes the input of the electric blower 8 depending on the change in the gate current.

The control power supply unit 46 converts the voltage of the rechargeable battery 4 into a control power supply voltage that is suitable for the driving of the controller 9.

The voltage detector 47 is connected in parallel to the rechargeable battery 4. The voltage detector 47 measures the terminal voltage of the rechargeable battery 4, converts the measurement result into an electric signal, and outputs it to the controller 9.

The current detector 48 is connected in series to the electric blower 8. The current detector 48 measures the current flowing in the electric blower 8, converts the measurement result into an electric signal, and outputs the electric signal to the controller 9. When a constant current is supplied to the electric blower 8, specifically, when a constant current is supplied to the electric blower 8 by switching the switching element 45, a predetermined setting value of the constant current may be substituted for the measured value of the current detector 48 without using the current detector 48. The predetermined setting value of the constant current corresponds to the input of the electric blower 8 to be set for each of the operation modes, e.g., the strong operation mode, the medium operation mode, and the weak operation mode.

Incidentally, the internal resistance of the rechargeable battery 4 is influenced by the temperature and the degree of deterioration of the rechargeable battery 4. As the temperature of the rechargeable battery 4 decreases and the deterioration of the rechargeable battery 4 progresses, the internal resistance of the rechargeable battery 4 increases.

Under the state where the internal resistance of the rechargeable battery 4 is higher than in the normal state, when the electric blower 8 is started while maintaining the discharge current of the rechargeable battery 4 and consequently the current flowing through the electric blower 8, the voltage drop of the battery 4 increases more than in the normal state. When the voltage drop increases, there is a possibility that the terminal voltage of the rechargeable battery 4 drops below the discharge cut-off voltage.

This decrease in terminal voltage occurs irrespective of the charging rate of the rechargeable battery 4. Thus, even in the state where the charging rate of the rechargeable battery 4 is sufficient, when the electric blower 8 is stopped immediately after its start due to the fact that the terminal voltage of the rechargeable battery 4 has fallen below the discharge cut-off voltage, the convenience for a user is impaired.

For this reason, the controller 9 estimates the internal resistance of the rechargeable battery 4 from the ΔV between the terminal voltage V1 of the rechargeable battery 4 while the electric blower 8 is stopped and the terminal voltage V2 of the rechargeable battery 4 after the predetermined time has elapsed since the electric blower 8 has been started up. Further, the controller 9 changes the current flowing through the electric blower 8 (i.e., the discharge current of the rechargeable battery 4) by controlling the switching element 45 such that the current terminal voltage of the rechargeable battery 4 becomes larger than the discharge cut-off voltage of the rechargeable battery 4 under the condition where the internal resistance of the rechargeable battery 4 is the estimated value. Hereinafter, the above-described control of changing the discharge current of the rechargeable battery 4 is referred to as the discharge current adjustment control.

When the controller 9 supplies a constant current to the electric blower 8 by switching the switching element 45, the controller 9 prevents the constant current control during the discharge current adjustment control.

The discharge current adjustment control performed by the controller 9 will be described in detail.

Figure 3:
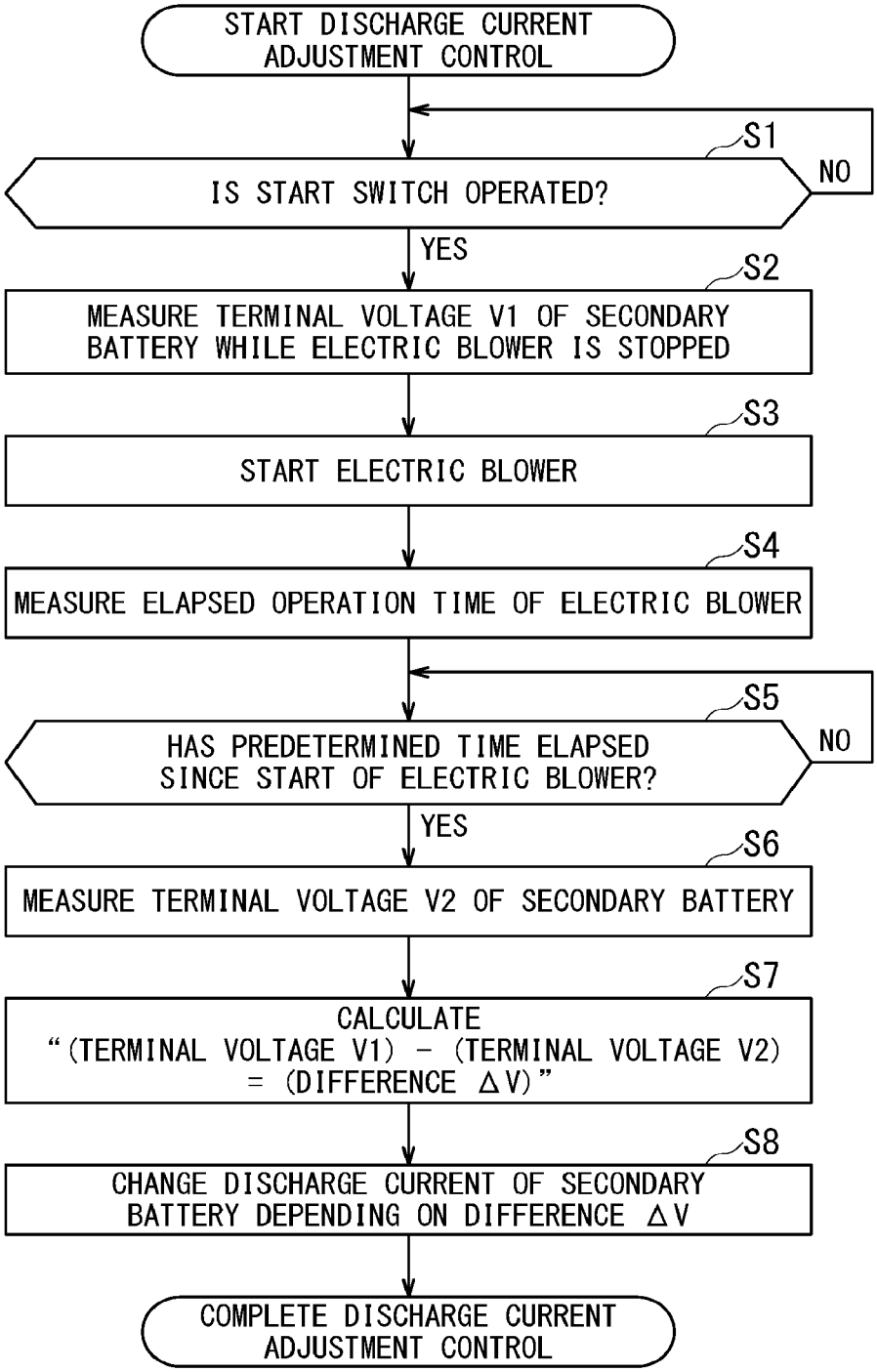
FIG. 3 is a flowchart illustrating discharge current adjustment control of the electric vacuum cleaner according to the present embodiment.

FIG. 3 is a flowchart illustrating the discharge current adjustment control of the electric vacuum cleaner according to the present embodiment.

As shown in FIG. 3, the controller 9 of the electric vacuum cleaner 1 according to the present embodiment starts under the state where the rechargeable battery 4 is attached to the cleaner body 2, and starts the discharge current adjustment control. The controller 9 monitors the start switch 24*b* of the operation unit 24 (NO in the step S1). When the start switch 24*b* of the operation unit 24 is operated (YES in the step S1), in the step S2 before the electric blower 8 is started, the controller 9 measures the terminal voltage V1 of the rechargeable battery 4 under the state where the electric blower is stopped. Specifically, the controller 9 acquires the detection result outputted from the voltage detector 47, and temporarily stores the detection result as the terminal voltage V1.

After the controller 9 measures the terminal voltage V1 in the step S2, the controller 9 controls the switching element 45 so as to start the electric blower 8 in the step S3. When the controller 9 starts the electric blower 8, the controller 9 counts the elapsed time in the step S4. When a predetermined time, e.g., 2 seconds elapses from the start of the electric blower 8 (YES in the step S5), the controller 9 measures the terminal voltage V2 of the rechargeable battery 4 in the step S6. Specifically, the controller 9 acquires the detection result outputted from the voltage detector 47, and temporarily stores the detection result as the terminal voltage V2.

In the step S7, the controller 9 calculates (terminal voltage V1)−(terminal voltage V2)=(difference ΔV). That is, the controller 9 calculates the difference ΔV by subtracting the terminal voltage V2 from the terminal voltage V1. In the step S8, the controller 9 changes the current flowing in the electric blower 8 (i.e., the discharge current of the rechargeable battery 4) according to the difference ΔV.

Each time the controller 9 starts the electric blower 8, the controller 9 performs the discharge current adjustment control. In other words, the controller 9 changes the discharge current of the rechargeable battery 4 on the basis of the difference ΔV each time the controller 9 starts the electric blower 8.

There are roughly two methods for changing the discharge current in the step S8.

The first method is a method of decreasing the discharge current of the rechargeable battery 4 depending on the difference ΔV. This is called a decrease mode. In the decrease mode, when the electric blower 8 is started in the step S3, the discharge current of the rechargeable battery 4 is set to the same value as the normal drive control of the electric blower 8 (i.e., the same input value as the setting value in the selected operation mode). In the step S8, the controller 9 decreases the duty ratio of the switching element 45 according to the difference ΔV and lowers the current flowing in the electric blower 8, i.e., the discharge current of the rechargeable battery 4.

In the decrease mode, it is not necessarily required to lower the discharge current of the rechargeable battery 4 according to the difference ΔV. For instance, the controller 9 may be configured to drive the electric blower 8 depending on the difference ΔV in the following manner. That is, the controller 9 drives the electric blower 8 by changing the discharge current of the rechargeable battery 4 when the difference ΔV is larger than the predetermined threshold value, and performs regular driving of the electric blower 8 (e.g., by using a constant current intended for the constant current control, i.e., by using the same input value as the setting value in the selected operation mode) without changing the discharge current of the rechargeable battery 4 when the difference ΔV is equal to or smaller than the predetermined threshold value. In consideration of the degree of temperature decrease of the rechargeable battery 4 and the progress of degradation of the rechargeable battery 4, this threshold value is preferably set within a range in which the terminal voltage of the rechargeable battery 4 is reliably expected to be equal to or higher than the discharge cut-off voltage of the rechargeable battery 4.

The second method is a method of increasing the discharge current of the rechargeable battery 4 according to the difference ΔV. This is called an increase mode. In the increase mode, when the electric blower 8 is started in the step S3, the discharge current of the rechargeable battery 4 is set to a value as low as possible regardless of the temperature condition and/or deterioration state of the rechargeable battery 4 in such a manner that the terminal voltage of the rechargeable battery 4 becomes larger than the discharge cut-off voltage of the rechargeable battery 4. In the step S8, the controller 9 increases the duty ratio of the switching element 45 according to the difference ΔV, and increases the current flowing in the electric blower 8, i.e., the discharge current of the rechargeable battery 4.

In both of the decrease mode and the increasing mode, the controller 9 estimates the internal resistance of the rechargeable battery 4 from the difference ΔV and the current flowing in the electric blower 8 and changes the current flowing in the electric blower 8 (i.e., the discharge current of the rechargeable battery 4) by controlling the switching element 45, in such a manner that the current terminal voltage of the rechargeable battery 4 becomes larger than the discharge cut-off voltage of the rechargeable battery 4 under the condition where the internal resistance of the rechargeable battery 4 is the estimated value. As to both of the estimated value of the internal resistance of the rechargeable battery 4 and the discharge current value of the rechargeable battery 4 which makes the terminal voltage of the rechargeable battery 4 larger than its discharge cut-off voltage at the estimated internal resistance, both may be sequentially computed and set by the controller 9 or may be preliminarily stored in the storage device of the controller 9 after determining the desirable discharge current value of the rechargeable battery 4 at the difference ΔV by experiment.

Even when the terminal voltage of the rechargeable battery 4 is equal to or lower than the discharge cut-off voltage of the rechargeable battery 4, the controller 9 keeps driving the electric blower 8 so as to restrain the electric blower 8 from stopping until the following three conditions are satisfied. Firstly, the predetermined time (e.g., 2 seconds) elapses after the start of the electric blower 8, corresponding to NO in the step S5. Secondly, the processing of the step S8 is completed after the elapse of the predetermined time in the above-described first condition. Thirdly, a determination time (e.g., 5 seconds) required for stabilizing the terminal voltage of the rechargeable battery (e.g., 5 seconds) elapses after completion of the processing of the step S8. The main factor of increasing the voltage drop at the time of start of the electric blower 8 is the low temperature state of the rechargeable battery 4 or progression of deterioration of the rechargeable battery 4. However, the life of the rechargeable battery 4 is not greatly impaired by restraining the stop.

Figure 4:
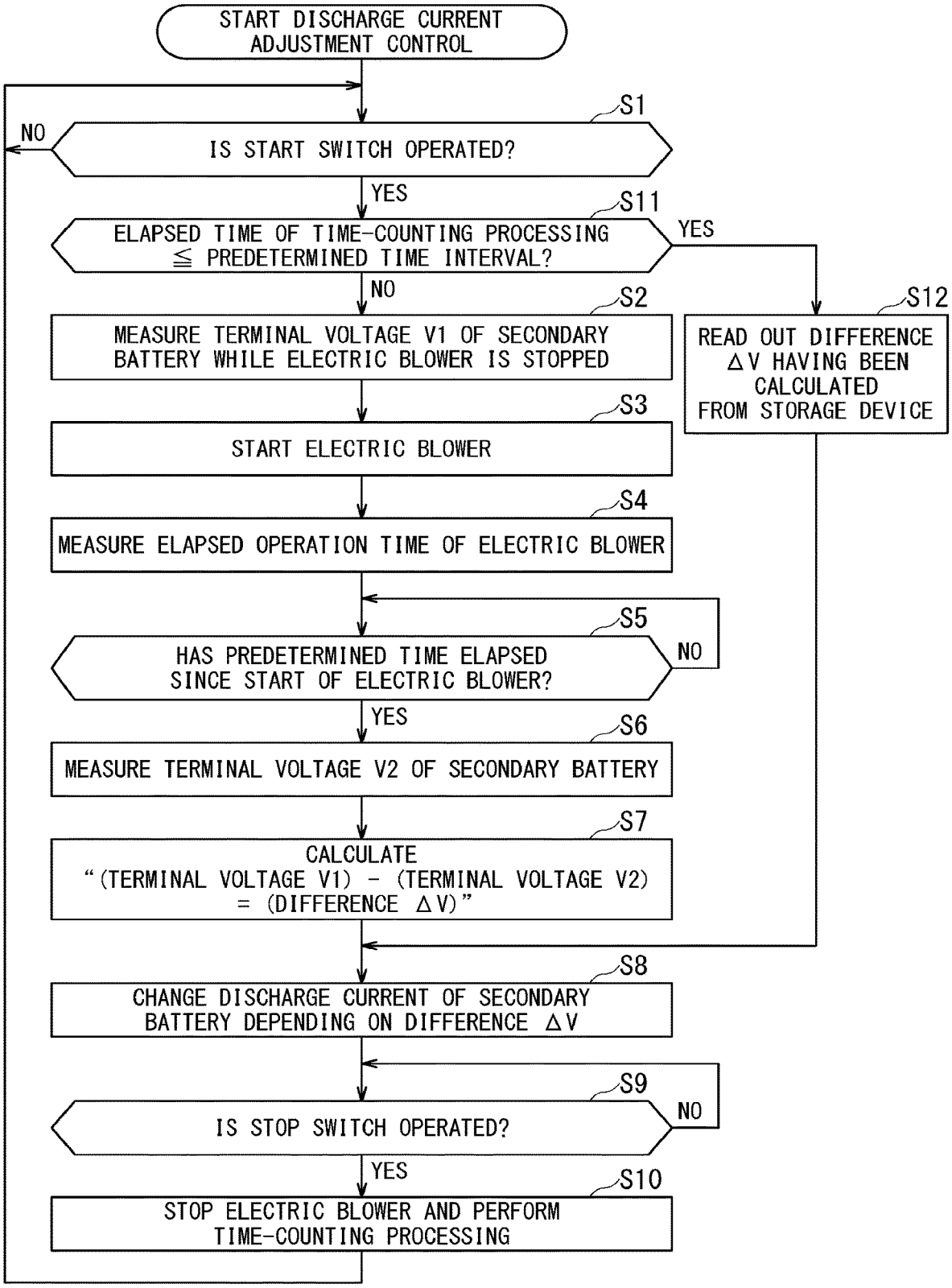
FIG. 4 is a flowchart illustrating another aspect of the discharge current adjustment control of the electric vacuum cleaner according to the present embodiment.

FIG. 4 is a flowchart illustrating another aspect of the discharge current adjustment control of the electric vacuum cleaner according to the present embodiment.

The steps S1 to S8 in FIG. 4 are the same processing as the steps S1 to S8 in FIG. 3, respectively, and duplicate description is omitted.

As shown in FIG. 4, when the elapsed time from stop to restart of the electric blower 8 is within the predetermined time interval, the controller 9 of the electric vacuum cleaner 1 according to the present embodiment changes the discharge current of the rechargeable battery 4 on the basis of the difference ΔV having been calculated before stopping the electric blower 8. The extent of this time interval is set to a time period that is short enough to determine whether the electric vacuum cleaner 1 is temporarily stopped or not during the cleaning by the user. For instance, this time interval is set to 1 minute. Further, the interval of the temporary stop of the electric vacuum cleaner 1 is set so as to be shorter than the time interval required for the rechargeable battery 4 having discharged and generated heat to be cooled down to about the ambient temperature or the time interval required for the rechargeable battery 4 to follow and reach the ambient temperature in association with temperature change during one day (i.e., temperature change between day and night)

Specifically, when the stop switch 24*a* of the operation unit 24 is operated while the controller 9 changes the discharge current of the rechargeable battery 4 in the step S8 and the electric blower 8 is being driven (YES in the step S9), the controller 9 stops the electric blower 8 and substantially simultaneously performs the time-counting processing (in the step S10). Thereafter, the processing returns to the step S1.

Next, when the start switch 24*b* of the operation unit 24 is operated again (Yes in the step S1), in the step S11, the controller 9 compares the elapsed time of the time-counting processing started in the step S10 with the predetermined time interval by which the controller 9 can determine it to be temporary stop (e.g., 1 minute).

When the time from the stop to restart of the electric blower 8, i.e., the elapsed time of the time-counting processing started in the step S10 is within the predetermined time interval (Yes in the step S11), the controller 9 reads out the difference ΔV, which is calculated before stopping the electric blower 8, from the storage device in the step S12. After reading out the difference ΔV having been calculated from the storage device in the step S12, the controller 9 bypasses the steps S2 to S7 and changes the discharge current of the rechargeable battery 4 in the step S8 on the basis of the difference ΔV calculated before stopping the electric blower 8. In other words, though the electric blower 8 is restarted plural times, when the elapsed time from the stop to restart of the electric blower 8 is within the predetermined time interval, the controller 9 performs the processing of the step S8 on the basis of the latest difference ΔV calculated in the step S7, each time of the restart.

Conversely, when the elapsed time of the time-counting processing started in the step S10 exceeds the predetermined time interval as NO in the step S11 (i.e., when it is not the temporary stop but the temperature of the rechargeable battery 4 is about the ambient temperature), the processing proceeds to the step S2 and the subsequent processing is executed.

In the electric vacuum cleaner 1 according to the present embodiment configured as described above, the discharge current of the rechargeable battery 4 is changed on the basis of the difference ΔV between the terminal voltage V1 of the rechargeable battery 4 while the electric blower 8 is stopped and the terminal voltage V2 of the rechargeable battery 4 after the predetermined time has elapsed since the electric blower 8 has been started up. Consequently, even under the condition where the internal resistance of the rechargeable battery 4 increases due to temperature decrease of the rechargeable battery 4 and/or progression of deterioration of the rechargeable battery 4 and thereby starting the electric blower 8 causes the voltage drop to increase, the electric vacuum cleaner 1 can prevent the electric blower 8 from stopping immediately after starting and can continue driving of the electric blower 8.

In addition, the electric vacuum cleaner 1 according to the present embodiment changes the discharge current of the rechargeable battery 4 when the difference ΔV is larger than the predetermined threshold value. Consequently, under an ideal driving condition in which the rechargeable battery 4 does not deteriorate or decrease in temperature, the electric vacuum cleaner 1 can perform regular driving of the electric blower 8.

Further, the electric vacuum cleaner 1 according to the present embodiment changes the discharge current of the rechargeable battery 4 on the basis of the difference ΔV every time the electric blower 8 is started. Consequently, each time the electric blower 8 is started, the electric vacuum cleaner 1 can make the discharge current of the rechargeable battery 4 appropriate.

Moreover, when the elapsed time from the stop to restart of the electric blower 8 is within the predetermined time interval, the electric vacuum cleaner 1 according to the present embodiment changes the discharge current of the rechargeable battery 4 on the basis of the difference ΔV calculated before stopping the electric blower 8. Consequently, even under the condition where the electric blower 8 is restarted many times within a short period of time, the electric vacuum cleaner 1 can appropriately set the discharge current of the rechargeable battery 4.

Furthermore, even when the terminal voltage of the rechargeable battery 4 is equal to or lower than the discharge cut-off voltage, the electric vacuum cleaner 1 according to the present embodiment continues to drive the electric blower 8 until the determination time longer than the predetermined time elapses from the start of the electric blower 8 and the terminal voltage V2 of the rechargeable battery 4 is measured. Consequently, even when the terminal voltage of the rechargeable battery 4 becomes equal to or lower than the discharge cut-off voltage due to increase in the voltage drop, the electric vacuum cleaner 1 can continue driving of the electric blower 8 without stopping the electric blower 8 regardless of the remaining battery level of the rechargeable battery 4.

Therefore, according to the electric vacuum cleaner 1 of the present invention, even in the state where the internal resistance of the rechargeable battery 4 is increased, it is possible to continue driving of the electric blower 8, increase the operation time, and improve convenience for a user.

As long as the rechargeable battery 4 is used as a power source for the electric blower 8, the electric vacuum cleaner 1 according to the present embodiment is not limited to a canister type and may be an electric vacuum cleaner of any type such as an upright type, a stick type, and a handy type.

While certain embodiment has been described, this embodiment has been presented by way of example only, and is not intended to limit the scope of the inventions. Indeed, the novel embodiment described herein may be embodied in a variety of other forms; furthermore, various omissions, substitutions and changes in the form of the embodiment described herein may be made without departing from the spirit of the inventions. The accompanying claims and their equivalents are intended to cover such forms or modifications as would fall within the scope and spirit of the inventions.

REFERENCE SIGNS LIST

1 electric vacuum cleaner
2 cleaner body
3 hose
4 rechargeable battery
5 body housing
6 wheel
7 dust separation/collection device
8 electric blower
9 controller
11 power cord
12 body connection port
14 insertion plug
19 connecting tube
21 dust collecting hose
22 hand operation tube
23 grip
24 operation unit
24*a* stop switch
24*b* start switch
24*c* brush switch
25 extension tube
26 cleaning head
28 suction port
29 rotatable brush
31 electric motor
41 control circuit
43 electric path
45 switching element
46 control power supply unit
47 voltage detector
48 current detector

The invention claimed is:

1. An electric vacuum cleaner comprising:

a rechargeable battery;

an electric blower that generates negative pressure by consuming electricity stored in the rechargeable battery; and a controller configured to control driving of the electric blower, and change a discharge current of the rechargeable battery such that a current terminal voltage of the rechargeable battery becomes larger than a discharge cut-off voltage of the rechargeable battery based on a current flowing in the electric blower and difference between a terminal voltage of the rechargeable battery while the electric blower is stopped and a terminal voltage of the rechargeable battery after a predetermined time has elapsed since the electric blower has been started up.

2. The electric vacuum cleaner according to claim 1, wherein the controller is configured to change the discharge current of the rechargeable battery when the difference is larger than a predetermined threshold value.

3. The electric vacuum cleaner according to claim 2, wherein the controller is configured to change the discharge current of the rechargeable battery based on the difference each time the controller starts the electric blower.

4. The electric vacuum cleaner according to claim 3, wherein the controller is configured to continue the driving of the electric blower until a determination time longer than the predetermined time elapses, even when a terminal voltage of the rechargeable battery is equal to or smaller than the discharge cut-off voltage.

5. The electric vacuum cleaner according to claim 2, wherein the controller is configured to change the discharge current of the rechargeable battery based on the difference calculated before stop of the electric blower, when elapsed time from the stop of the electric blower to restart of the electric blower is within a predetermined time interval.

6. The electric vacuum cleaner according to claim 5, wherein the controller is configured to continue the driving of the electric blower until a determination time longer than the predetermined time elapses, even when a terminal voltage of the rechargeable battery is equal to or smaller than the discharge cut-off voltage.

7. The electric vacuum cleaner according to claim 2, wherein the controller is configured to continue the driving of the electric blower until a determination time longer than the predetermined time elapses, even when a terminal voltage of the rechargeable battery is equal to or smaller than the discharge cut-off voltage.

8. The electric vacuum cleaner according to claim 1, wherein the controller is configured to change the discharge current of the rechargeable battery based on the difference each time the controller starts the electric blower.

9. The electric vacuum cleaner according to claim 8, wherein the controller is configured to continue the driving of the electric blower until a determination time longer than the predetermined time elapses, even when a terminal voltage of the rechargeable battery is equal to or smaller than the discharge cut-off voltage.

10. The electric vacuum cleaner according to claim 1, wherein the controller is configured to change the discharge current of the rechargeable battery based on the difference calculated before stop of the electric blower, when elapsed time from the stop of the electric blower to restart of the electric blower is within a predetermined time interval.

11. The electric vacuum cleaner according to claim 10, wherein the controller is configured to continue the driving of the electric blower until a determination time longer than the predetermined time elapses, even when a terminal voltage of the rechargeable battery is equal to or smaller than the discharge cut-off voltage.

12. The electric vacuum cleaner according to claim 1, wherein the controller is configured to continue the driving of the electric blower until a determination time longer than the predetermined time elapses, even when a terminal voltage of the rechargeable battery is equal to or smaller than the discharge cut-off voltage.

* * * * *